United States Patent [19]

Grassart

[11] Patent Number: 4,965,757

[45] Date of Patent: Oct. 23, 1990

[54] PROCESS AND DEVICE FOR DECODING A CODE SIGNAL

[75] Inventor: Francis Grassart, Chapelle-Lez-Herlaimont, Belgium

[73] Assignee: ACEC, Societe Anonyme, Brussels, Belgium

[21] Appl. No.: 388,312

[22] Filed: Jul. 31, 1989

Related U.S. Application Data

[63] Continuation of Ser. No. 138,275, Dec. 28, 1987, abandoned.

[30] Foreign Application Priority Data

Dec. 30, 1986 [EP] European Pat. Off. ..... 86870201.0

[51] Int. Cl.[5] ..... G01R 23/16; G06F 15/332

[52] U.S. Cl. ..... 364/576; 364/726; 341/156; 324/77 B

[58] Field of Search ..... 364/576, 726, 827; 341/156, 157, 158; 73/587; 340/348-354; 324/77 B

[56] References Cited

U.S. PATENT DOCUMENTS

| | | | |
|---|---|---|---|
| 3,848,115 | 11/1974 | Sloane et al. | 364/576 |
| 3,958,781 | 5/1976 | Woods et al. | 246/34 R |
| 4,107,775 | 8/1978 | Ott | 364/576 |
| 4,501,149 | 2/1985 | Konno et al. | 73/587 |
| 4,516,249 | 5/1985 | Cook et al. | 364/726 |
| 4,539,518 | 9/1985 | Kitayoshi | 324/77 B |
| 4,607,216 | 8/1986 | Yamaguchi | 324/77 B |
| 4,626,827 | 12/1986 | Kitamura et al. | 340/347 SH |
| 4,701,934 | 10/1987 | Jasper | 364/576 |
| 4,715,000 | 12/1987 | Premerlani | 364/484 |

FOREIGN PATENT DOCUMENTS 3148735 10/1986 Fed. Rep. of Germany .

*Primary Examiner*—Parshotam S. Lall
*Assistant Examiner*—V. N. Trans
*Attorney, Agent, or Firm*—Foley & Lardner, Schwartz, Jeffery, Schwaab, Mack, Blumenthal & Evans

[57] ABSTRACT

After sampling and conversion into digital values, the digitalized temporal samples of the received code signal (SC) are subjected to a fast Fourier transformation, and the information items (FFT) representing the frequencies of the transform are processed automatically in such a manner as to compare spectra of the transform with stored theoretical values for each possible code signal, in order to determine a set of information items called "conversions" (M1-Mn), from among which a selector then selects a particular "conversion" (MSO) which will reliably identify the received code signal and will activate a display device.

18 Claims, 5 Drawing Sheets

PROCESS AND DEVICE FOR DECODING A CODE SIGNAL

Figure 1:
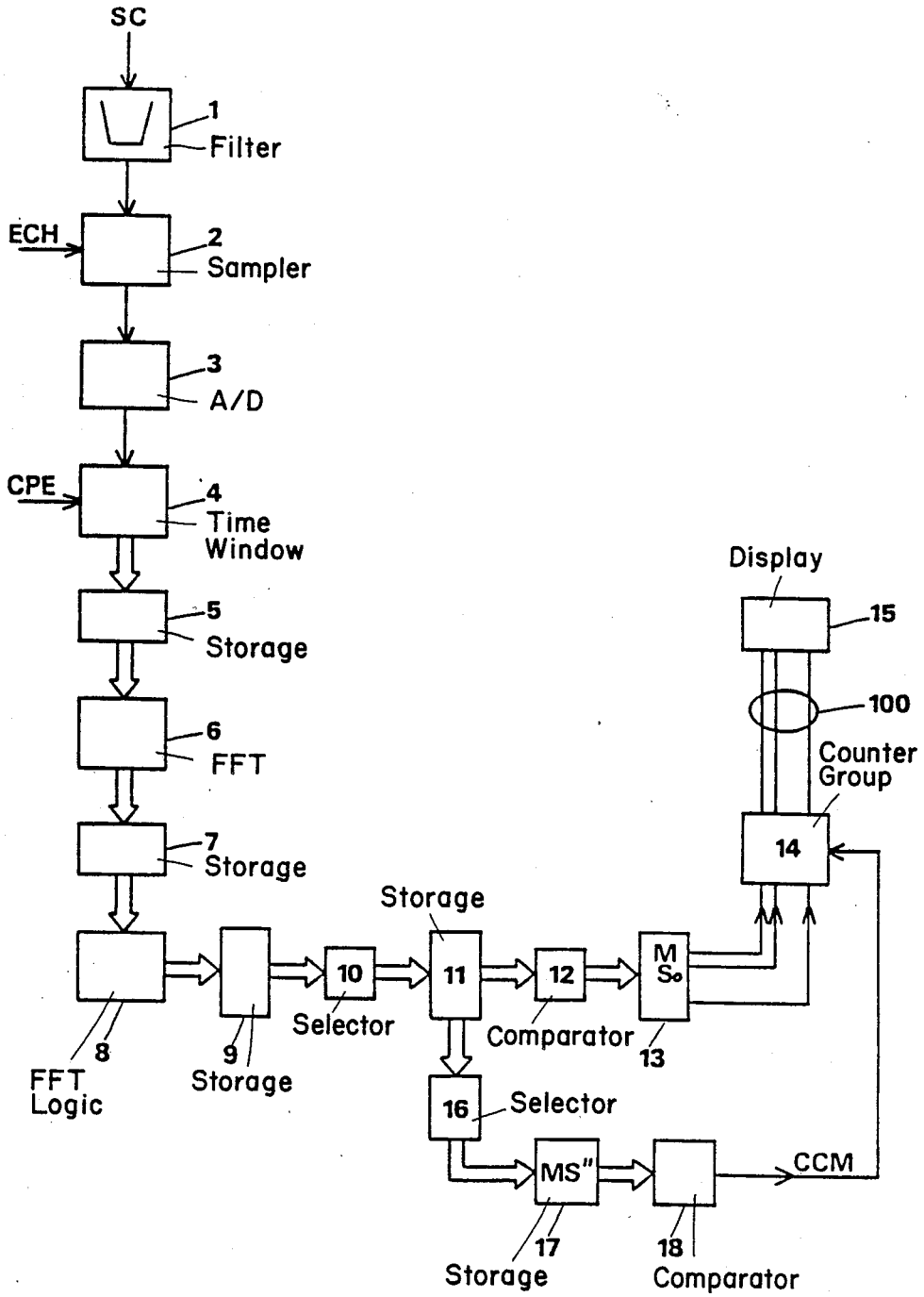

This application is a continuation of application Ser. No. 07/138,275, filed Dec. 28, 1987abandoned.

The present invention relates to a process and a device for decoding a code signal produced by modulation of a carrier current at a predetermined frequency and for recognizing this code signal among a plurality of possible signals with a low probability of error.

A typical example of code signal with which the invention is concerned is the signal produced by a coded track circuit used in a railroad network for signaling to the driver of a train the limiting speed authorized for the convoy at the place where the train is situated. In this application, the code signal is produced by a carrier current which is amplitude-modulated at a determined frequency. Each modulation frequency is associated with a specified limiting speed.

The modulation frequencies are, for example, 75, 96, 120, 147, 180 and 220 pulses per minute, with a tolerance of plus or minus two pulses per minute on a carrier current having a frequency of 75±3 hertz. There are then six possible code signals which may, for example, be associated with the following limiting speeds, one code per speed:

Code 1 220 pulses per minute: 60 km/h maximum
Code 2 180 pulses per minute: 80 km/h maximum
Code 3 147 pulses per minute: 120 km/h maximum
Code 4 120 pulses per minute: 130 km/h maximum
Code 5 96 pulses per minute: 140 km/h maximum
Code 6 75 pulses per minute: automatic release.

The code signals which flow in the track circuits are sensed by an antenna on board the train and transmitted to the driving cab, where a decoder analyzes them in order to display the authorized limiting speed in clear on the control panel.

The problem posed in this type of application consists in that each code signal must be decoded and recognized by the decoder with a very low probability of error, in spite of the irregularities which may be exhibited by the recieved code signal and in spite of the inevitable presence of parasitic signals.

The perturbations which may degrade the code signal are distributed in four groups, according to their origin: change of the modulation frequency (discontinuity of the code signal), phase rotation of the carrier current when passing a track switch or from one track section to the following one, instantaneous variation of the level of the code signal or instantaneous phase jump, presence of current flowing in the track and originating from external sources (return traction currents, circulation current, crosstalk).

The known apparatuses for decoding the code signals of the above described type make use of analog demodulation and filtration circuits. Nevertheless, the precision and the stability of the decoding which is provided by these known apparatuses are variable, both depending upon the operating conditions and from one apparatus to another; this necessitates the periodic implementation of maintenance measures and calibrations of the apparatuses installed. Furthermore, the complexity and hence the space requirement of these apparatuses increase with the performance levels achieved with regard to the reliability of the decoding.

The subject of the invention is a process and a device for decoding, which alleviate the disadvantages of the prior art.

This object is achieved, according to the invention, by virtue of a process for decoding comprising the following steps:

after sampling at a suitable sampling frequency, the amplitudes of the temporal samples in successive blocks of samples of specified length are converted into digital values;

the digital values of the time samples are transferred into the frequency domain by means of a fast Fourier transformation in such a manner as to produce and to store a set of digital signals, the FFT data, representing the frequencies of the transform (the instant aqueous spectral distribution);

the digital data FFT representing the frequencies measured (the instantaneous spectral distribution) are compared with stored theoretical frequency spectra in order to generate a set of information items (M1–Mn) called "conversions" the values of which represent the differences between the frequencies measured and the theoretical frequency spectrum for each possible code ;

from the set of the stored "conversions", for each possible code the conversion which has greatest correspondence to theoretical spectrum is selected and stored as particular "conversions" ($MS_1$-$MS_N$);

from the set of data of stored particular conversions ($MS_1$-$MS_N$), that conversion which has the greatest value (MSO) corresponding to a theoretical spectrum is selected and stored;

in response to the selected particular conversion (MSO), a signaling message (MSC) is generated, which identifies the received code signal (SC), this signaling message (MSC) being intended to activate a display device (15).

This process is carried out in a device which, according to a second aspect of the invention, is defined in that it comprises a sampler to sample the code signal and to produce a sequence of temporal samples in successive blocks of specified length;

an analog-digital converter to convert the amplitudes of the temporal samples of each block of samples into digital values;

a storage element to store the digital values;

a transformation element organized, under the control of a stored program, to cause the stored digital values to undergo a fast Fourier transformation and to produce a set of digital FFT data representing the frequencies of the transform (the instantaneous spectral distribtution);

a logic organization element (8, 9) to compare, under the direction of the stored program, the digital FFT data corresponding to each frequency situated in the range within which the carrier frequency can vary with digital signals (FFT) representing frequencies corresponding to the harmonics of the modulation frequency, in order to produce a set of information items representing the differences of position of the frequencies measured, and means organized to compare the information items representing the differences of position with stored data which represent the theoretical amplitudes of the frequencies, in order to generate a set of information items (M1–Mn) called "conversions" for each code signal;

means for selecting from among the set of conversions (M1–Mn) and storing, for each code signal, the particular conversion which has the greatest value ($MS_{1-MSN}$);

means for selecting from among the "conversions" (MS1–MSN) corresponding to the various code signals, the conversion datum having the greatest value (MSO);

a device for generating a signaling message in response to the reception of the selected conversion datum and for transmitting this message to a display device.

Figure 2:
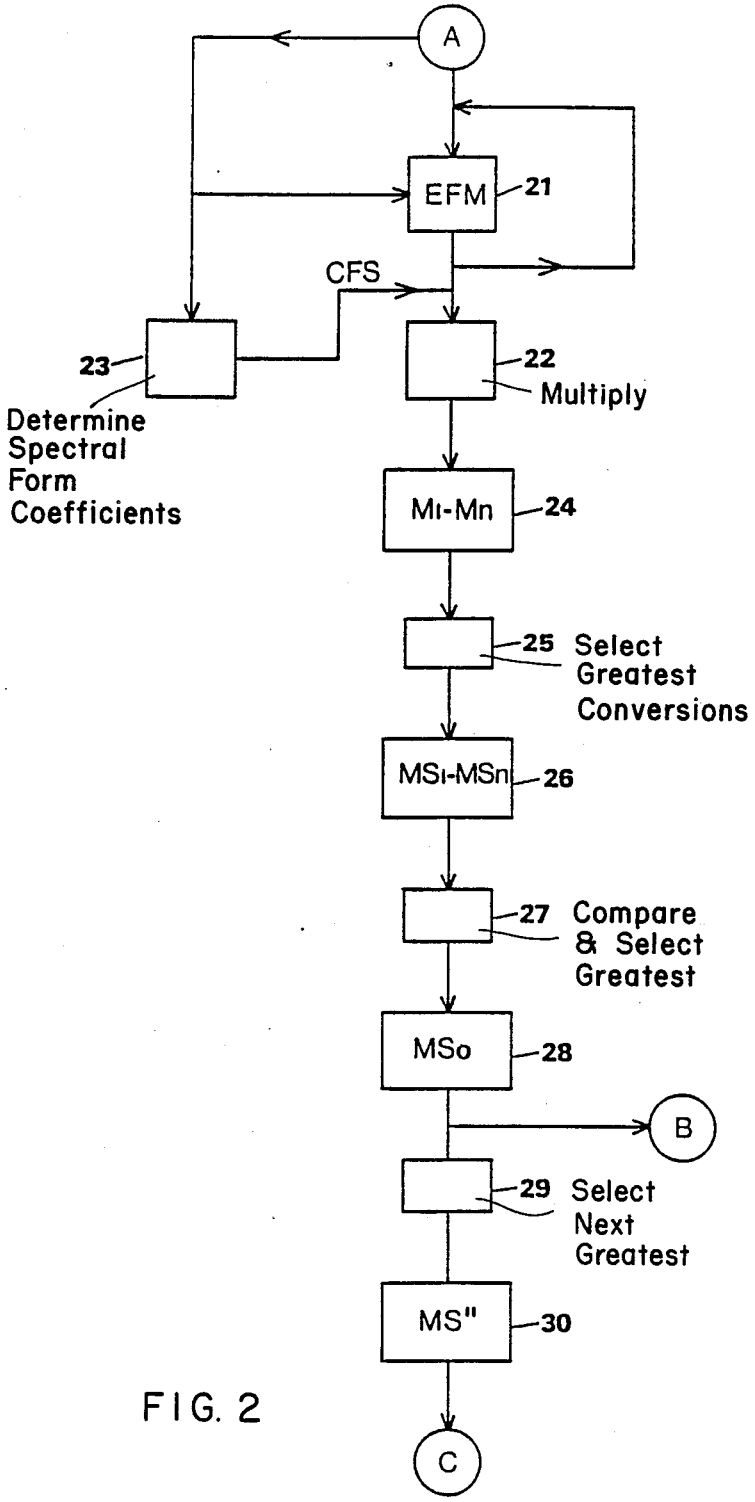
Figure 3A:
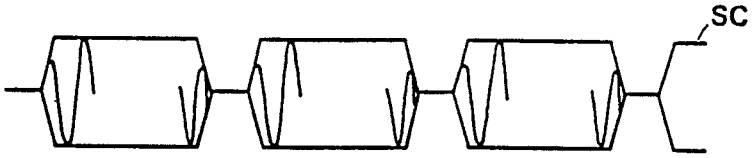
Figure 3B:
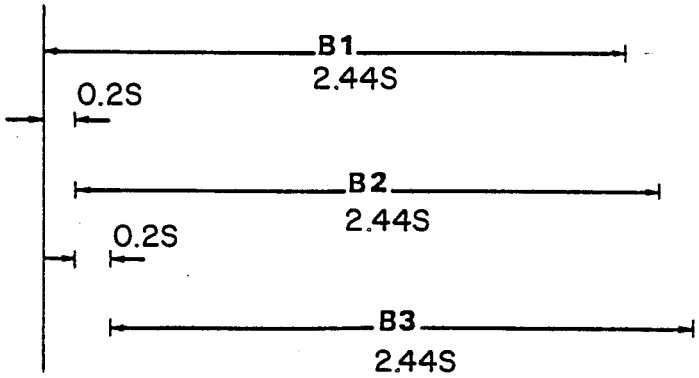
Figure 4:
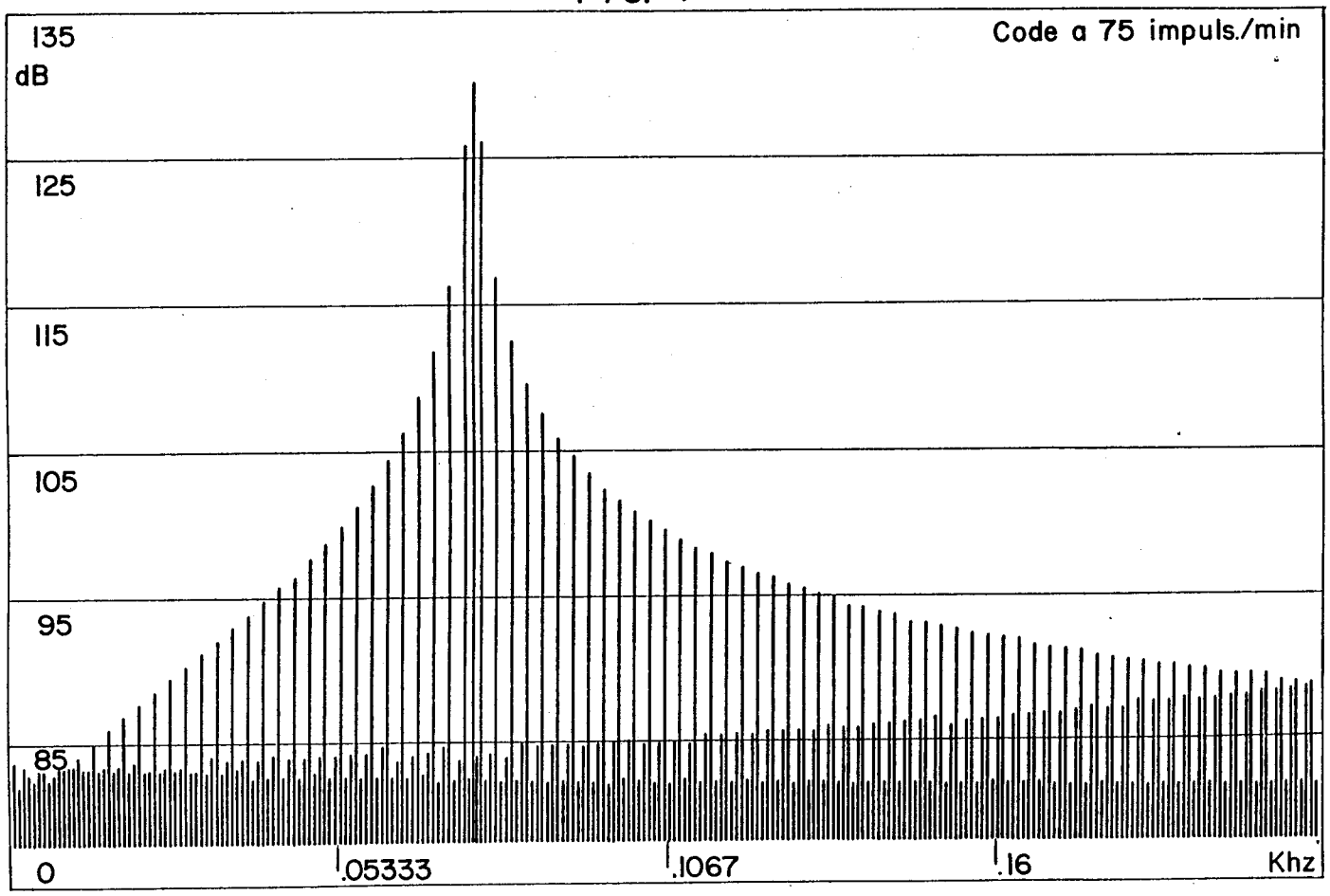
Figure 5:
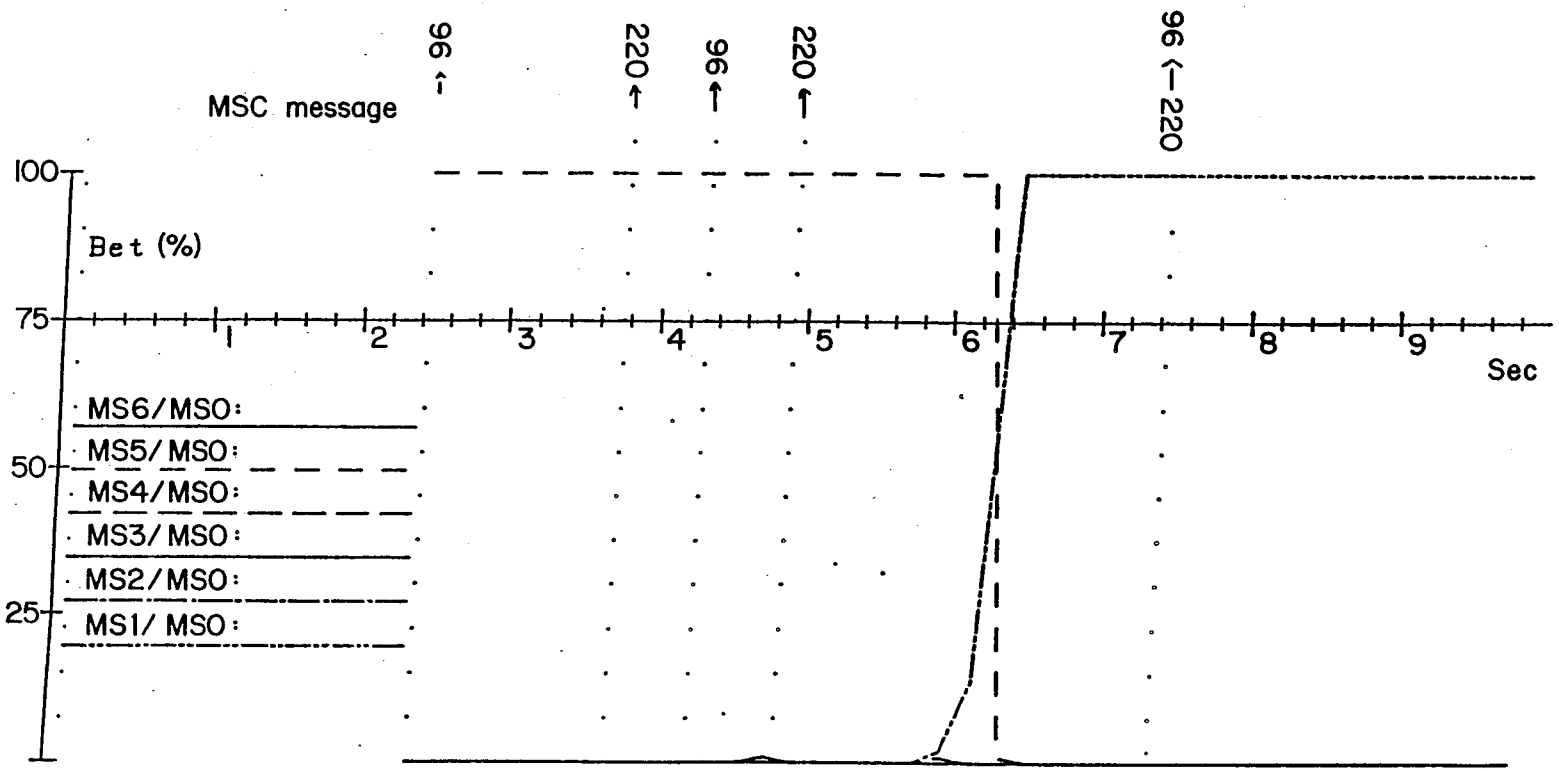

The invention will appear more clearly on reading the description which follows, given with reference to the accompanying drawings, in which:

FIG. 1 is a linear block diagram of the decoder according to the invention,

FIG. 2 is a chain diagram illustrating the process of analysis according to the invention, FIG. 3 is a diagram showing a typical code signal waveform, and a specimen displacement of blocks of temporal samples derived from this code signal, FIG. 4 is a diagram showing a specimen Fourier transform spectrum, FIG. 5 is a diagram illustrating the performance of embodiment of the decoder according to the invention.

Referring to FIG. 1, this figure shows a linear functional diagram of the device according to the invention. In this figure, the elements represented symbolize elements which participate and cooperate in order to execute a same function in the decoding process, which will be described, but need not be distinct substantive elements. Thus, for example, certain elements in FIG. 1 represent elements for receiving and/or storing signals or data; these elements may, as is customary in the field of the art, be constituted by storage zones or cells reserved on a same substrate.

The device according to the invention is intended for decoding of code signals produced by modulation of a carrier current at predetermined distinct frequencies and to recognize a code signal among a plurality of possible signals. An example of a typical received code signal is shown in FIGS. 3A and 3B. What is involved is a signal obtained by all-or-nothing amplitude modulation. Nevertheless, it is clearly understood that the decoding process according to the invention is applicable to other forms of modulation (for example, frequency modulation or phase modulation).

In the device according to the invention, the analog code signal SC, after customary filtering in a filter 1, is received in a sampling device 2 to be sampled at a sampling frequency ECH which is sufficient to satisfy the Nyquist criterion, that is to say a sampling frequency at least equal to twice the highest frequency present in the composite signal. Such sampling devices are known in the art. The amplitudes of the temporal samples are converted into digital values in an analog-digital converter 3.

Blocks of samples converted into digital form, of given length, are taken and transmitted successively in a time window 4, in such a manner as to favor, in each block, the in the central portion of the block samples as compared with the samples, at the margins or edges of the block, this being done in order to avoid the appearance of parasitic signals due to the discontinuity of the signal at the limits of each temporal block if the latter does not contain an integral number of alternations of the carrier. The length of a block of temporal samples is, for example, 2.44 seconds, with a displacement of 0.2 second from one block to the other. FIG. 3B shows the displacement of three blocks of temporal samples B1, B2, B3 derived from the specimen code signal SC.

Each temporal sample within a block is multiplied by a coefficient whose value is determined by the position of the sample within the block. The value of multiplication coefficients CPE follow a half sine wave curve, thus weighting the temporal samples in the center of the block more heavily than samples at the edges or margins of the block.

The digital values of the digitalized samples of each successive block are received in a storage element 5 in order then to be transposed into the frequency domain by a fast Fourier transformation in a known manner. The means for Fourier transformation is diagramatically represented at 6. The Fourier transformation permits determination of the amplitude of each harmonic of a frequency in a composite signal from the form of this signal.

In the case of an all-or-nothing amplitude modulation of a carrier current of frequency $f=\omega/2\pi$, for example, with a modulation amplitude A, the instantaneous value of the composite signal, "a" is given by the relation set out below:

$$a=(Ao+A1\cos\Omega t+A3\cos 3\Omega t+\ldots)\sin\omega t \quad (1)$$

in which $\Omega$ is the pulsation of the modulation signal and A1, A2, A3 . . . are the amplitudes of the harmonics of the modulation frequency $F=\Omega/2\pi$.

In the example of a block of temporal samples of 2.44 seconds, the frequencies of the transform are displaced by approximately 25 pulses per minute. FIG. 4 shows the spectrum of the transform for a modulation rate of 75 pulses per minute on a carrier frequency of 75 hertz. It will be noted that the harmonics of the modulation frequency correspond to certain frequencies of the transform around the carrier of 75 hertz, which can vary within a range of frequencies ranging from 72 to 78 hertz.

The fast Fourier transformation is undertaken automatically in a transformation element 6, known in the art under the direction of a stored program. After transformation, each block of samples is represented by a set of digital signals which define the amplitudes of frequencies of the transform. In the text which follows, these digital signals will be called "FFT data".

The FFT data are received in a storage cell 7 with a view to being subsequently processed automatically according to the invention, in order to verify whether the instantaneous spectral distribution corresponding to the carrier frequency and to the harmonics of the modulation frequency is close to the theoretical distribution for a given code signal.

The automatic processing of the FFT data in accordance with the present invention is effected in a logic organization element represented diagramatically at 8, under the direction of a stored analysis program. The logic organization element 8 may certainly be combined with the transformation element 6, and the analysis program may be integrated with the FFT transformation program in a general software for digital processing.

The procedure for processing the FFT data is illustrated by the chain diagram of FIG. 2. The initial status A represents the storage of the set of FFT data in the storage cell 7 of FIG. 1. For each block of temporal samples, the FFT datum corresponding to each one of frequencies in the range of frequencies of the carrier is multiplied (function 21) by the FFT data representing the frequencies corresponding to the harmonics for each code signal. In the example of a length of a block of temporal samples of 2.44 seconds with a carrier which can vary within the range 72 to 78 hertz, the FFT datum corresponding to each one of seventeen frequencies is thus multiplied by FFT data corresponding to the harmonics for each possible code, according to equation 1, for example. At the output of the stage 21, the processing procedure determines a set of information items linked to the differences of position of the frequencies measured, from the frequencies for each code possible, these data being called "EFM information items" in the text which follows. With the seventeen frequencies in the range of frequencies within which the carrier can vary, by taking into consideration the odd harmonics 1 to 7, for example, a set of 102 EFM information items (6 codes, 17 frequencies) is thus determined.

Each EFM information item is multiplied (function 22) by a digital datum (less than unity) called "spectral form coefficient" (CFS) which penalizes the EFM information in proportion to the difference between the value of this information item and its theoretical value, that is to say in proportion to the difference between the amplitude of each measured band frequency and the theoretical amplitudes of the possible codes resulting from the relation (1) mentioned above.

The spectral form coefficient is determined (function 23), for each measured frequency, from the stored FFT datum (status A) by comparing this FFT datum with the stored corresponding theoretical datum deduced from the relation (1) and located in a memory forming part of the logic organization element 8 of FIG. 1.

At the output of the stage 22, the logic organization element 8 has determined a set of numerical values M1, M2 . . . Mn (n=102 in the example cited above) which are greater, the better the correspondence between the set of frequencies to which they relate and the relation (1) for a given code. These information items will be called "conversions". These 102 conversions M1–Mn are stored (function 24) in a storage cell 9 (FIG. 1). Among this set of conversions, a selector 10 (FIG. 1) then selects (function 25), for each code signal, the one conversion which has the greatest value in the range of frequencies considered. For each block of samples which is analysed, these information items $MS_1$-$MS_N$ called particular conversions (N=6 in the example considered here) are recieved (function 26) in a storage cell 11 (FIG. 1).

It will be observed that, according to the invention, there is a correspondence between each one of the data $MS_1$-$MS_N$ and the code signal from which the block of samples which is being analysed has been extracted. Following this, among these stored data ($MS_1$-$MS_N$), a comparator 12 references (function 27) that which has the greatest value $MS_O$ among the set of particular conversions and this value is stored (function 28) in a storage cell 13. This datum $MS_O$, which reliably identifies the code signal SC received, selects an individual counter for this code. The group of counters is represented in its entirety at 14 in FIG. 1. In order that it should be certain that the code signal identified by the conversion MSo selected by the decoding procedure described in the foregoing text, is indeed a code signal which is stable and not instantaneously perturbed by a modulation phase jump or changes in neighboring codes, the output message MSC is delayed until a sufficient number of confirmations is given by the analysis of several successive blocks of temporal samples. In response to the datum $MS_0$ applied to its validation input, each counter is decremented and one of them is then incremented by a value defined automatically by the decoder. From the set of "conversion" $MS_1$-$MS_N$ which are stored in the cell 11, a selector 16 selects (function 29) the second greatest value MS", and this datum MS" is stored (function 30) in a storage cell 17. A comparator 18 determines (function 30) the ratio between the first greatest value MSo and the second value MS". The value of this ratio is called "instantaneous confidence coefficient" CCM. This coefficient determines the value of the increment applied to the counter 14 corresponding to the identified code signal. The output of that one of the counters 14 which has the highest value, in the line 100 routes to a display device 15, a message MSC which identifies the code signal and which serves to indicate a corresponding code signal on the display device 15.

In the absence of perturbation, the counter 14 selected is incremented in response to the CCM signal. The counter 14 is thus incremented in the course of the analysis by one or more successive blocks of samples, and the signaling message MSC can then be transmitted to the display device 15.

On the other hand, when there is instantaneous perturbation, after having been incremented as a function of the confidence coefficient CCM, the counter 14 selected is decremented during the analysis of a subsequent block of samples. The decoding procedure according to the invention thus ensures a reliable identification of a code signal among a plurality of possible code signals.

The invention even ensures a very reliable decoding where there is a change of code or in the event of perturbation. FIG. 5 illustrates, for example, the reactions of a decoder in the form of a ratio $$\frac{MS(N)}{MSo}$$

according to the invention where there is a change of a code at 96.15 pulses per minute on a carrier at 75 hertz (code 5, approximately 96 pulses per minute) to a code at 220.6 pulses per minute (code 220pulses per monute). The code 5 of approximately 96 pulses per m is maintained until the instant t=3.75 seconds. Throughout this period of time, the code 5 of approximately 96 pulses per minutes is the only one to have a significant value (horizontal line at 100% representing a ratio $$\frac{MS(S)}{MS_o}).$$

The confidence coefficient is very high. At the instant t=3.75 seconds, the code 5 of approximately 96 pulses per minute is replaced by the code 1 of approximately 220 pulses per m until the instant t=4.3 seconds, when there is an instantaneous return to the code 5 of approximately 96 pulses per minute until the instant t=4.9 seconds. At this instant, there is final transfer to the code 1 of approximately 220 pulses per minute. It is observed that the decoder filters perfectly this "hiccough" between the instants t=4.3 seconds and t=4.9 seconds, since the output of the decoder (indicated close to the 100% level line) shows a clean transition between the two codes. The maximum value at the instant t=6.05 seconds, transitions from MS5/MSo TO MS1/MSo reflecting the transition from code 5 to code 1, then the filtered output at the instant t=7.4 seconds generates code message MSC. Similar transitions have been observed in other cases.

In the aforegoing text, the decoding processing was effected only on the odd harmonics of the modulation. This assumes symmetry of the received code signal. When the received code signal exhibits significant asymmetry between the time, $t_o$, of lock-in to and the time of release, T, of the carrier, certain values of the cyclic ratio, to/T, can give rise to the elimination of one of the harmonics which are used in the determination of the "conversion" and the appearance of even harmonics. In the case where the code signal emitted has a cyclic ratio below 0.45 or above 0.55, it will be expedient to provide likewise a spectral analysis as described above based on the even harmonics.

In the applications where it proves to be necessary to improve the elimination of the crosstalk in the railroad tracks, it may be beneficial to provide a sampling of the code signal in a synchronous manner in each rail: two blocks of information items are then available, in which the components of the useful signal are in phase opposition, while the crosstalk signals are frequently in phase therein. Depending upon the particular cases, it is possible:

to process one of the two blocks of information items as described above and to check, in the other block, that the spectral bands which constitute the selected code are indeed in phase opposition, or to select, first of all, the bands in phase opposition in the two blocks of information items and to apply to these bands only the processing according to the invention, or to subtract the two blocks of information items one from the other and to apply to the resultant block the processing procedure as described above.

What is claimed is:

1. A process for decoding received coded signals (SC) produced by modulation of a carrier current at a predetermined rate and for recognizing a code signal among a plurality of possible code signals, comprising the steps of:

sampling the received coded signals at a sampling frequency, converting amplitudes of temporal samples in successive blocks of samples of specified length into corresponding digital values, transforming the digital values into a frequency domain by means of a fast Fourier transform to produce and store a set of digital FFT spectral data representing measured frequencies of the transform;

comparing the digital FFT spectral data representing the measured frequencies with stored theoretical frequency spectra for the possible code signals and generating therefrom a set of information items (M1–Mn) called "conversions", the values of the conversions representing differences between the measured frequencies and theoretical frequencies for each of the possible code signals;

for each of the possible code signals selecting from the set of stored "conversions", the conversion which has a greatest correspondence to that possible code signal and storing these conversions ($Ms_1$–$MS_N$) as a set of particular conversions;

from the set of stored particular conversions ($MS_1$–$MS_N$), selecting and storing that one conversion which has a greatest spectral correspondence (MSo) indicating a corresponding with one of the possible codes;

generating in response to the selected conversion (MSo), a signal message (MSC), which identifies the received code signal (SC), this signaling message (MSC) activating a display device.

2. The process recited in claim 1, wherein each one of the digital FFT spectra corresponding to a frequency situated within a range within which the carrier frequency can vary is compared with digital FFT spectra corresponding to harmonics of the modulation frequency, thereby producing a set of information items (EFM) representing differences of position of the frequencies measured; and wherein the information items (EFM) representing the differences of position of the frequencies are compared with stored data representing theoretical amplitudes of the frequencies, in order to generate the set of "conversions" (M1–Mn).

3. The process recited in claim 1, wherein the digital values corresponding to the blocks of temporal samples are transmitted in a time window before being subjected to fast Fourier transformation.

4. The process recited in claim 1, wherein generation of the signaling message (MSC) is delayed until the selected "conversion" (MSo) results from analysis of a plurality of successive blocks of temporal samples.

5. The process as claimed in claim 4, wherein the successive blocks of temporal samples (B1, B2 . . . ) overlap.

6. a device for decoding received coded signals produced by modulation of a carrier current at a predetermined frequency and for recognizing a code signal among a plurality of possible code signals, comprising:

a sampler for sampling the received coded signals (SC) and producing a sequence of temporal samples in successive blocks of specified length;

an analog-digital converter for converting amplitudes of the temporal samples of each block of samples into digital values;

a storage element for storing the digital values;

a transformation element controlled by a stored program, for performing a fast Fourier transform on the stored digital values thereby producing a set of digital FFT signals representing measured frequencies of the transform;

a logic organization element controlled by a stored program, for comparing the digital FFT signals representing the frequencies measured with stored theoretical spectra for the possible code signals and for generating therefrom a set of information items (M1–Mn) called "conversions" representing the differences between the measured spectra and the theoretical spectra, for each possible code signal;

means for selecting from among the set of conversions (M1–Mn), for each possible code signal, a conversion which has a greatest correspondence and for storing these conversions as a set of particular conversions ($MS_1$–$MS_N$);

means for selecting from among the set of particular conversions ($MS_1$–$MS_N$) a particular conversion which has a greatest value (MSo);

a device for generating a signaling message (MSC) in response to the reception of the selected particular conversion (MSo) and for transmitting this message (MSC) to a display device (15).

7. The device recited in claim 6, wherein the logic organization element for producing and storing the set of "conversions" (M1–Mn) comprises means organized to compare the digital FFT signals corresponding to each frequency situated within the range within which the carrier frequency can vary with digital signals representing frequencies corresponding to harmonics of the modulation frequency, and for producing therefrom a set of information items (EFM) representing differences of position of the frequencies measured, and means organized to compare the information items (EFM) representing the differences of position with stored data which represent theoretical amplitudes of the frequencies for each possible code, in order to generate the set of "conversions" $M_1$–$M_n$.

8. The device recited in claim 6, comprising a device for delaying transmission of the signaling message (MSC) to the display device until the signaling message (MSC) has been maintained during a period of time after reception of at least two successive blocks of temporal samples.

9. The device recited in claim 8, wherein the period of time for delay in the transmission of the signaling message (MSC) is determined by a counting device responding to the selected particular "conversion" (MSo) following analysis of each block of temporal samples the counting device being incremented by a value determined as a function of a ratio between the selected particular conversion and a second "conversion" of greater value (MS'') in the set of particular "conversions" ($MS_1$–$MS_N$) at each analysis of a block of successive samples, until an output of the counting device produces the signaling message.

10. The device recited in claim 9, wherein the counting device comprises a counter for each code signal to be decoded, the outputs of the counters forming a code message.

11. A process for decoding a received coded signal (SC) produced by modulation of a carrier current at a predetermined rate and for recognizing a code signal among a plurality of possible code signals comprising the steps of:

sampling amplitudes of signals taken from successive sample blocks of specified lengths and converting the samples into digital values, transforming the digital values into the frequency domain by means of a fast Fourier transformation in such a manner as to produce and store a set of digital signals named hereafter "FTT data", the set of digital signals in each sample block defining an instantaneous spectral distribution of the received coded signal, for each possible code signal and for each of the data within the range of the possible frequency variations of the carrier current, determining a product of the FFT data and harmonics of the modulation frequency to obtain a set of values named hereafter "EFM information" representing deviation of the measured frequency, reducing each EFM information value by an amount determined by digital spectral form coefficient data representing amplitude deviations between the instantaneous spectral distribution and theoretical line distribution linked to a corresponding code signal to obtain for each possible code signal a set of digital values named hereafter "conversions" ($M_1$–$M_n$), the values of the conversions being greater as the instantaneous spectral distribution is nearer to the theoretical distribution, storing the conversions ($M_1$–$M_n$) and selecting the conversion having the largest value for each possible code signal thereby obtaining for each sample block a set of information (MSl–$MS_n$) named particular conversions where each particularly conversion being linked to a possible code signal, selecting from among the particular conversions (MSl–$MS_n$), the conversion having the largest value, MSo, the selected particular conversion indicating a code, and producing a signal message (MSC) identifying the code signal to operate a display panel.

12. The process recited in claim 11, wherein each sample is multiplied by a coefficient (CPE), whose value depends upon location of the sample in a sampling block before being subjected to the fast Fourier transform.

13. The process recited in claim 12, wherein the successive sampling blocks overlap each other by a 1/12.

14. The process recited in claim 11, wherein a counter for each code exists and the selected particular conversion MSo selects a counter for the code to be incremented by a fixed value, and whereby counters for other codes are decremented by the same fixed value, the counter which, by successive increments reaches a value higher than the other counters, delivering a signal message (MSC).

15. The process recited in claim 11, wherein an MS'' value corresponding to the second largest value among the particular conversions, is selected to form a ratio called "instantaneous confidence coefficient" (CCM), whereby the selected special conversion, MSo, selects the counter which will be incremented by a value depending upon the instantaneous confidence coefficient (CCM), whereby all other counters are decremented by the same value and whereby the counter which, by successive increments, reaches a value higher than the other counters, delivers the signal message (MSC).

16. A device for decoding a received coded signal (SC) produced by modulation of a carrier current at a predetermined frequency, and for recognizing a code among a plurality of possible code signals comprising:

a sampler for sampling the received code signal (SC) and producing a set of samples in the successive blocks of specified lengths, an analog/digital converter for converting the amplitudes of the sample blocks into digital values, a transformation element designed to transform, under the control of a stored program, the stored digital values by a fast Fourier transform and to produce a set of digital signals, named hereafter "FTT data" representing the instantaneous spectral distribution of the code signal, a logical organization element which determines the instantaneous spectral distribution which is closest to a theoretical distribution, linked to a corresponding code signal for each code signal and for each of the FTT data, within a range of possible frequency variations of the carrier current, means for multiplying the FTT data corresponding to the frequency of the carrier current by the FTT data respectively corresponding to the harmonics of the modulation frequency of the possible code signals to obtain a set of values, named hereafter "EFM information" representing deviation of the measured frequency, means for reducing each EFM information by spectral form coefficient digital data, the spectral form coefficient data, representing amplitude deviations between the instantaneous spectral distribution and theoretical line distribution linked to a corresponding code signal to obtain for each possible code signal a set of digital data, named hereafter "conversions" ($M_1$–$M_n$) the values of the conversions being greater as the instantaneous spectral distribution is nearer to the theoretical distribution, a storage cell for storing the conversions ($M_1$–$M_n$), means for selecting from the conversions a conversion having a largest value for each possible code signal thereby obtaining for each sample block a set of particular conversion ($MS_1$–$MS_n$), each particular conversion being linked to a possible code signal, a comparator for selecting from among the particular conversions MSl–MSn a particular conversion having a largest value MSo the selected particular conversion being used to create a corresponding signal message MSC and to drive a display panel.

17. The device as recited in claim 16, wherein a group of counters delays transmission of the signal message MSC to the display panel to permit, when several successive sample blocks are scanned, at least one confirmation of the selected special conversion MSo.

18. The device recited in claim 16, wherein the means for selecting:

determines among the stored special conversions MSl–MSN, a value MS corresponding to a second largest value, and further comprising, a storage cell for storing the MS values, a comparator for determining a ratio between the selected particular conversion MSo and the MS value to determine an instantaneous confidence coefficient ratio (CCM), used for incrementing a counter selected by the selected particular conversion MSo for the corresponding code, and for decrementing other counters corresponding to other codes.

* * * * *